United States Patent [19]

Burri et al.

[11] Patent Number: 4,776,280

[45] Date of Patent: Oct. 11, 1988

[54] SABOT PROJECTILE CONTAINING A SABOT REAR PORTION HAVING REFERENCE FRACTURE LOCATIONS

[75] Inventors: Jakob Burri, Zurich; Rudolf Rossmann, Bülach, both of Switzerland

[73] Assignee: Werkzeugmaschinenfabrik Oerlikon-Bührle AG, Zurich, Switzerland

[21] Appl. No.: 180,094

[22] Filed: Apr. 11, 1988

[30] Foreign Application Priority Data

Apr. 30, 1987 [CH] Switzerland ..... 01634/87

[51] Int. Cl.[4] ..... F42B 13/16

[52] U.S. Cl. ..... 102/523; 102/522

[58] Field of Search ..... 102/520–523

[56] References Cited

U.S. PATENT DOCUMENTS

| | | | |
|---|---|---|---|
| 3,927,618 | 12/1975 | Engel . | |
| 4,249,466 | 2/1981 | Rossmann et al. . | |
| 4,726,298 | 2/1988 | Sigg et al. | 102/523 |

FOREIGN PATENT DOCUMENTS

| | | |
|---|---|---|
| 0072584 | 2/1983 | European Pat. Off. . |
| 0131073 | 1/1985 | European Pat. Off. . |
| 2223477 | 11/1973 | Fed. Rep. of Germany . |
| 494389 | 7/1970 | Switzerland . |
| 536481 | 6/1973 | Switzerland . |
| 576217 | 3/1946 | United Kingdom . |
| 1362308 | 8/1974 | United Kingdom . |

*Primary Examiner*—Harold J. Tudor

*Attorney, Agent, or Firm*—Werner W. Kleeman

[57] ABSTRACT

In a sabot projectile the sabot must immediately detach from the projectile body upon exit of the projectile from the barrel muzzle of the firing weapon without the flight stability of the projectile body being impaired. For this purpose the sabot rear portion must fracture or break along the provided reference fracture locations. According to the invention the reference fracture locations are constructed such that the sabot positively fractures or breaks along the reference fracture locations. Hence, the heretofore conventional reference fracture locations are structured more reliably by the provision of one or more additional bores.

4 Claims, 2 Drawing Sheets

SABOT PROJECTILE CONTAINING A SABOT REAR PORTION HAVING REFERENCE FRACTURE LOCATIONS

CROSS REFERENCE TO RELATED APPLICATION

This application is related to the commonly assigned, copending U.S. patent application Ser. No. 400,618, filed July 22, 1982, and entitled "Connection Arrangement Between A Sabot Jacket And The Sabot Rear Portion Of A Sabot Projectile".

BACKGROUND OF THE INVENTION

The present invention broadly relates to a new and improved construction of a sabot projectile containing a sabot rear portion having reference fracture locations.

In its more specific aspects the present invention is directed to a new and improved construction of a sabot projectile containing a sabot tail or rear portion having reference fracture locations. The sabot projectile comprises a projectile body or penetrator, the sabot tail or rear portion in which the projectile body is anchored, a sabot jacket which surrounds the projectile body and a plurality of tongue or petal members secured at the sabot tail or rear portion by reference fracture locations. These tongue or petal members serve to anchor the projectile body in the sabot tail or rear portion, and the reference fracture locations are formed by two circumferential grooves.

Sabot projectiles of this general type belong to the state-of-the-art as disclosed, for instance, in U.S. Pat. Nos. 3,927,618, granted Dec. 23, 1975, 4,249,466, granted Feb. 10, 1981, Swiss Patent Nos. 494,389, granted July 31, 1970, 536,481, granted June 15, 1973, the British Patent Nos. 576,217, accepted Mar. 25, 1946 and 1,362,308, published Aug. 7, 1974.

It has been found that the aforementioned tongue members do not always break off in the desired manner at the related reference fracture location. In the event the complete sabot and, in particular, the sabot tail or rear portion does not immediately separate in the desired manner from the projectile body upon leaving the weapon barrel muzzle, then there is no longer insured stable flight of the projectile body.

SUMMARY OF THE INVENTION

With the foregoing in mind, it is therefore a primary object of the present invention to provide a new and improved construction of a sabot projectile which is not afflicted with the aforementioned drawbacks and shortcomings of the prior art constructions.

Another and more specific object of the present invention is directed to the provision of a new and improved construction of a reference fracture location for the sabot tail or rear portion of a sabot projectile and which reliably breaks or ruptures in desired manner and at a desired point of time.

Now in order to implement these and still further objects of the invention, which will become more readily apparent as the description proceeds, the construction of a sabot projectile containing a sabot tail or rear portion having reference fracture locations, as contemplated by the invention, is manifested, among other things, by the features that there is provided at least one bore which extends from the one circumferential groove to the other circumferential groove. Preferably, this bore is located on a side or edge region of the associated tongue or petal member.

However, there also can be provided a bore located at each of both sides of the tongue or petal member.

This construction of the reference fracture location has the following advantages:

(a) It is avoided that the sabot tail or rear portion breaks or fractures instead of the individual tongue or petal members breaking off.

(b) The root or anchor portion of the tongue or petal members, i.e. the location at which they should rupture or fracture or break off, can be structured in a stiffer or more rigid manner.

(c) Deviations in the quality of the used material are of lesser importance.

(d) The risk of undesired formation of cracks in the sabot tail or rear portion is reduced.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Describing now the drawings, it is to be understood that to simplify the showing thereof, only enough of the construction of the sabot projectile has been illustrated therein as is needed for one skilled in the art to readily understand the underlying principles and concepts of the present invention.

Figure 1:
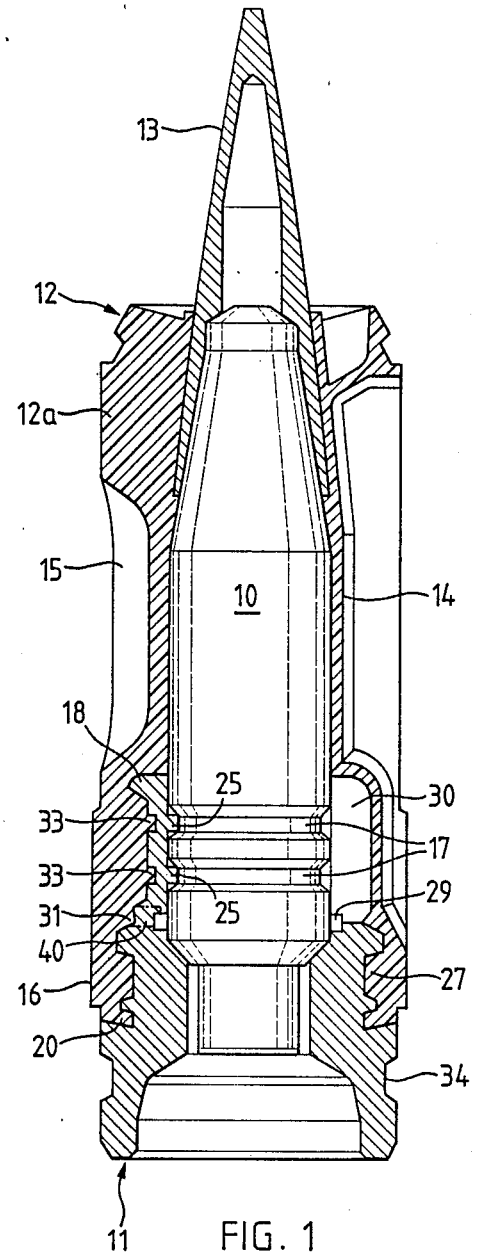
FIG. 1 is a longitudinal sectional view through a sabot projectile provided with a reference fracture location constructed according to the teachings of the present invention.

Turning now to the accompanying drawings, and specifically directing attention to FIG. 1 thereof, the exemplary embodiment of sabot projectile depicted therein will be seen to comprise a projectile body 10, a sabot tail or rear portion 11 and a sabot jacket or jacket member 12. Mounted upon the projectile body 10 is a ballistic hood 13. A hard metal alloy, preferably a tungsten alloy, can be beneficially used, as is well known in the ordnance arts, for fabricating the projectile body 10. The sabot tail or rear portion 11 is manufactured, for instance, preferably from a light metal and the sabot jacket 12 is fabricated, for instance, from a suitable plastics material, as likewise known in this technology. The sabot jacket 12 usually, but not necessarily, consists of three segments **12*a* which are interconnected with one another by suitable reference fracture locations 14. In the drawing of FIG. 1 there is visible only one of these reference fracture locations 14. Additionally, the sabot jacket 12 possesses recesses or depressions 15 and a guide or spin band 16. The projectile body 10 possesses two circumferential grooves 17 which serve for the attachment of the sabot tail or rear portion 11 to the projectile body 10. This sabot tail or rear portion 11 is provided with, for instance, six tongue or petal members 18 which protrude by means of protuberances or dogs or lugs 25 into the circumferential grooves 17 of the projectile body 10**.

In order that the sabot tail or rear portion 11 can separate from the projectile body 10 upon exit of the sabot projectile from the weapon barrel, there is provided an inner groove or recess 29 at the sabot tail or rear portion 11, by means of which a reference fracture location is formed, at which the tongue members 18 can be broken off from the sabot tail or rear portion 11. As particularly visible in FIG. 3, the six tongue members 18 are separated from each other by six slits or slots 30. By virtue of the provision of the inner groove 29 shown in FIG. 2 and also by virtue of the slits or slots 30 between the tongue members 18, these six tongue members 18, after the sabot proectile has left the weapon barrel and under the effect of the centrifugal force produced by the projectile spin, can be bent so far outwardly that they break off or rupture and thus no longer hold the projectile body 10 by means of their protuberances or dogs 25 in the circumferential grooves 17. To facilitate the release of the projectile body 10 there is provided still a further outer circumferential groove 31 at the sabot tail or rear portion 11. The wall thickness between the inner groove 29 and the outer circumferential groove 31, likewise defining a reference fracture location, is appropriately chosen such that the tongue members 18 can be readily broken or ruptured by the prevailing centrifugal force. This wall thickness can be empirically determined and depends upon the projectile spin and the strength of the material from which there is formed the sabot tail or rear portion 11.

Figure 3:
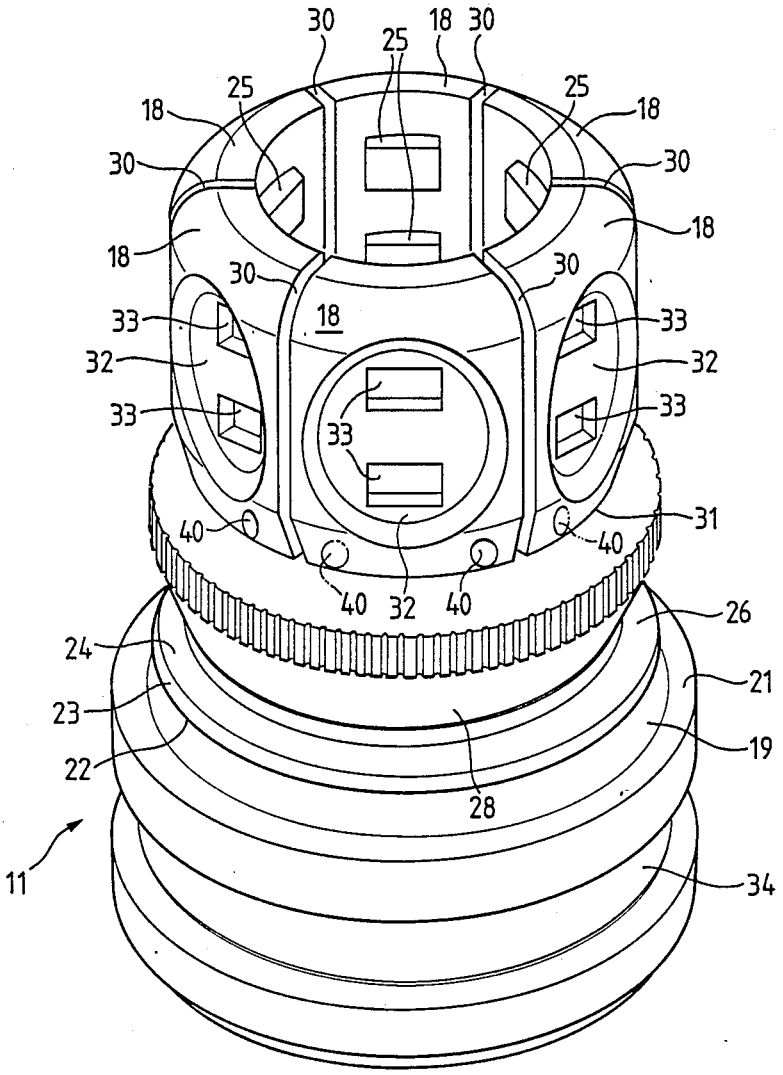
FIG. 3 shows a perspective illustration of the sabot tail or rear portion depicted in FIG. 2.

To fabricate the protuberances or dogs 25 or the like, which may only be formed after the projectile body 10 is inserted into the sabot tail or rear portion 11, there is provided a, for instance, substantially disc-shaped recess or depression 32 at each tongue member 18 as clearly shown in FIG. 3. As soon as the projectile body 10 is inserted into the sabot tail or rear portion 11, two quadrangular, such as rectangular recesses or openings 33 are pressed into the base or bottom **32*a* of each disc-shaped recess 32. There are thus formed the protuberances or dogs 25 by means of which the projectile body 10 is held in the sabot tail or rear portion 11, because these protuberances or dogs 25 project into the circumferential grooves 17**.

Additionally, the sabot tail or rear portion 11 possesses a further circumferential groove 34 which serves to secure a conventional cartridge case which thus has not been shown in the drawings.

Figure 2:
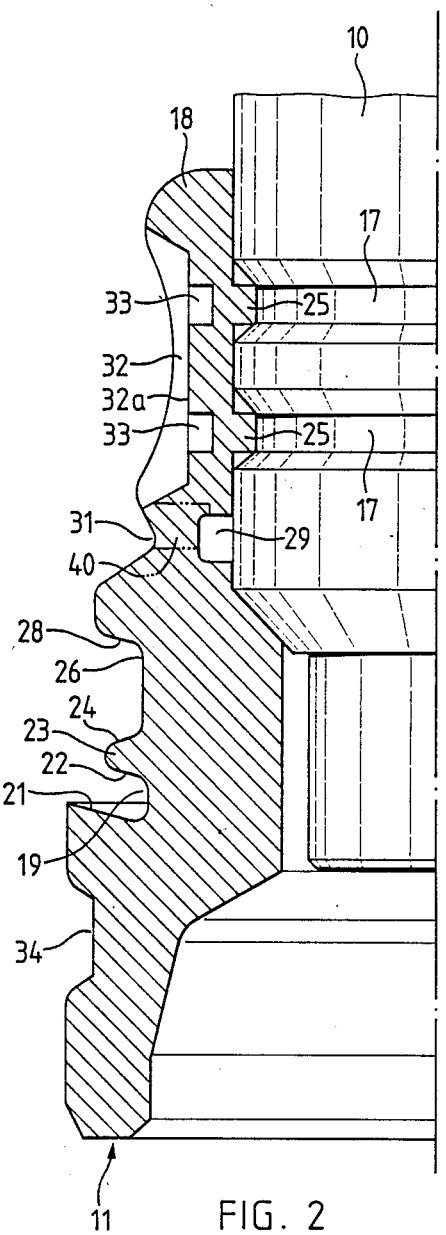
FIG. 2 is an enlarged detail showing of part of the sabot tail or rear portion of the sabot projectile depicted in FIG. 1.

In accordance with the showing of FIG. 2, the sabot tail or rear portion 11 possesses a circumferential sealing groove 19 and a circumferential holding or retaining groove 26. This circumferential sealing groove 19 is formed and bounded by two essentially mutually parallel side walls 21 and 22. These side walls 21 and 22 are inclined forwardly at an angle of about 75° with respect to the lengthwise axis of the firing weapon. As also depicted in FIG. 2, the circumferential holding or retaining groove 26 possesses two side walls 24 and 28, wherein the one side wall 24 is inclined rearwardly at an angle of about 75° and the other side wall 28 is inclined forwardly at an angle of about 75°. The circumferential holding or retaining groove 26 and the circumferential sealing groove 19 are separated from one another by a rib member 23.

In accordance with the teachings of the present invention, the reference fracture locations between the inner circumferential groove 29 and the outer circumferential groove 31 are provided with additional bores 40, which are illustrated in each of FIGS. 1 to 3. Either a single bore 40 can be disposed close or adjacent to one of the two slits or slots 30 at each tongue or petal member 18, or there can be provided two bores 40 for each tongue or petal member 18, and the one bore 40 is situated close or adjacent to the one slit or slot 30 and the other bore 40 is situated close or adjacent to the other slit or slot 30.

By means of these two bores 40 or even the single bore 40, it is possible to improve the formation of fissures or cracks, so that the tongue or petal members 18 can break off more readily without having to reduce the wall thickness between the two circumferential grooves 29 and 31.

While there are shown and described present preferred embodiments of the invention, it is to be distinctly understood that the invention is not limited thereto, but may be otherwise variously embodied and practiced within the scope of the following claims. Accordingly,

What we claim is:

1. A sabot projectile, comprising:

a sabot rear portion possessing reference fracture locations;

a projectile body;

said projectile body being anchored in the sabot rear portion;

a sabot jacket which surrounds said projectile body;

two circumferential grooves provided at the sabot rear portion;

said two circumferential grooves forming the reference fracture locations;

said sabot rear portion including a plurality of tongue members attached by means of the reference fracture locations to the sabot rear portion;

said plurality of tongue members serving to anchor said projectile body in the sabot rear portion; and each of the reference fracture locations being provided with at least one bore which extends from one of said two circumferential grooves to the other of said two circumferential grooves.

2. The sabot projectile as defined in claim 1, wherein:

said at least one bore is located at the region of one side of a related tongue member of said plurality of tongue members.

3. The sabot projectile as defined in claim 1, wherein:

each of the reference fracture locations being provided with two of said bores, each of which extend from one of said two circumferential grooves to the other of said two circumferential grooves;

one of said two bores being located adjacent one side of a related tongue member of said plurality of tongue members; and the other of said two bores being located adjacent the other side of said related tongue member.

4. A sabot projectile, comprising:

a sabot rear portion possessing reference fracture means;

a projectile body;

said projectile body being anchored in the sabot rear portion;

a sabot jacket which surrounds said projectile body;

two circumferential grooves provided at the sabot rear portion;

said two circumferential grooves forming the reference fracture means;

said sabot rear portion including a plurality of petal members attached by means of the reference fracture means to the sabot rear portion;

said plurality of petal members at least partially securing said projectile body in the sabot rear portion; and means provided for said reference fracture means and defining at least one bore which extends between said two circumferential grooves.

* * * * *